US006358402B1

(12) United States Patent
Schucker

(10) Patent No.: US 6,358,402 B1
(45) Date of Patent: Mar. 19, 2002

(54) EXTRACTIVE DISTILLATION PROCESS FOR THE REDUCTION OF SULFUR SPECIES IN HYDROCARBONS STREAMS

(75) Inventor: Robert C. Schucker, The Woodlands, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/473,463

(22) Filed: Dec. 28, 1999

(51) Int. Cl.[7] ..... C10G 29/20

(52) U.S. Cl. ..... 208/237; 208/313; 208/316; 208/322; 208/323; 208/330; 208/236; 208/237; 208/238; 203/51; 203/57

(58) Field of Search ..... 208/313, 316, 208/322, 323, 330, 236, 237, 238; 203/51, 57

(56) References Cited

U.S. PATENT DOCUMENTS

| | | | | |
|---|---|---|---|---|
| 2,123,642 A | | 7/1938 | Wiezevich et al. | 196/13 |
| 2,324,955 A | | 7/1943 | Rupp et al. | 196/85 |
| 2,455,803 A | | 12/1948 | Pierotti | 202/39.5 |
| 2,886,610 A | | 5/1959 | Georgian | 260/674 |
| 2,950,245 A | | 8/1960 | Thomsen et al. | 208/348 |
| 3,434,936 A | | 3/1969 | Luther et al. | 203/32 |
| 4,053,369 A | * | 10/1977 | Cines | 203/52 |
| 5,017,279 A | * | 5/1991 | Oswald et al. | 208/67 |
| 5,173,173 A | | 12/1992 | Vauk | 208/91 |
| 5,252,200 A | | 10/1993 | Skatulla et al. | 208/313 |
| 5,310,480 A | | 5/1994 | Vidueira | 208/313 |
| 5,582,714 A | * | 12/1996 | Forte | 208/237 |
| 5,689,033 A | * | 11/1997 | Forte et al. | 585/833 |
| 5,753,102 A | * | 5/1998 | Funakoshi et al. | 208/208 R |
| 5,961,820 A | | 10/1999 | Jeanblanc et al. | 208/231 |
| 6,007,707 A | * | 12/1999 | Donnermeyer et al. | 208/313 |

* cited by examiner

*Primary Examiner*—Nadine Preisch
(74) *Attorney, Agent, or Firm*—H. E. Naylor; G. J. Hughes

(57) ABSTRACT

A method for separating sulfur species from hydrocarbon streams, particularly cracked naphtha streams, using extractive distillation. The method effectively separates sulfur species from cracked naphtha streams without substantially lowering the olefin content.

22 Claims, 3 Drawing Sheets

EXTRACTIVE DISTILLATION PROCESS FOR THE REDUCTION OF SULFUR SPECIES IN HYDROCARBONS STREAMS

FIELD OF THE INVENTION

The present invention relates to a method for separating sulfur species from hydrocarbon streams, particularly cracked naphtha streams, using extractive distillation.

BACKGROUND OF THE INVENTION

Air pollution is a serious environmental problem. A major source of air pollution worldwide is the exhaust from fuel combusted in hundreds of millions of motor vehicles. Regulations have been enacted reflecting the need to reduce harmful motor vehicle emissions including nitrogen oxide (NOx) emissions through more restrictive fuel standards. The single most important factor in controlling NOx and toxic emissions is the amount of sulfur in the gasoline. In addition, fuels containing sulfur produce sulfur dioxide and other pollutants which lead to a host of environmental concerns, such as smog and related health issues, acid rain leading to deforestation, and water pollution, as well as a number of other environmental problems. In order to reduce or eliminate these environmental problems, the sulfur content of fuels has been, and will continue to be restricted to increasingly smaller concentrations, such as, for example, less than 150 or even 30 parts per million (ppm).

The problem of sulfur in fuels is compounded in many areas where there are diminishing or no domestic sources of crude oil having relatively low sulfur content. For example, in the United States the supply of domestic oil production relies increasingly on lower grade crude oil with higher sulfur content. The need for lower sulfur content fuel increases demand for imported oil having lower sulfur content, thereby increasing trade imbalance and vulnerability due to dependence on foreign sources of oil. The sulfur content in crude oil can take the form of a wide variety of both aliphatic and aromatic sulfurous hydrocarbons.

Various techniques have been developed to remove sulfur compounds from oil. One such technique, called catalytic hydrodesulfurization (HDS), involves reacting hydrogen with the sulfur compounds in the presence of a catalyst. HDS is one process within a class of processes called hydrotreating, or hydroprocessing, involving the introduction and reaction of hydrogen with various hydrocarbonaceous compounds. Hydrotreatment has been used to remove sulfur, nitrogen, and other materials such as metals, not only for environmental purposes but to avoid adverse impact on catalysts used in subsequent processing.

Cracked naphtha obtained as a product of a cracking or a coking operation may contain a significant concentration of sulfur up to as much as 13,000 ppm. Although the cracked naphtha stream constitutes approximately half of the total gasoline pool, cracked naphtha contributes a substantial quantity of undesired sulfur to the gasoline pool. The remainder of the pool typically contains much lower quantities of sulfur. The sulfur content can be decreased by (i) hydrotreating the entire feedstock to the cracking/coker unit or (ii) hydrotreating the product naphtha from these units.

Alternative (i) is a very expensive "brute force" effort that is very expensive in that it (a) requires a large hydrotreater, and (b) it consumes significant quantities of hydrogen. Alternative (ii) is a more direct approach, but unfortunately HDS of product naphtha using standard hydrotreating catalysts under conditions required for sulfur removal results in undesirable saturation of olefins. Typically olefins are present in the original feed in an amount of about 20 vol % to about 60 vol %, down to levels as low as about 2 vol %. During typical HDS of product naphtha the olefin content may be reduced, and the reduction in olefin content reduces the octane number of the product gasoline. The reduced octane number associated with desulfurization means that the fuel ultimately will need more refining, such as isomerization, blending, or other refining, to produce higher octane fuel, adding significantly to production expenses.

Selective HDS to remove sulfur while minimizing hydrogenation of olefins and octane reduction by various techniques, such as selective catalysis, has been described in the literature.

One non-hydrotreating option for reducing sulfur in cat-naphtha streams is liquid-liquid extraction. This process separates the sulfur species from the naphtha by decantation in the liquid phase. However an unacceptably large portion of the hydrocarbons are also extracted into the solvent with sulfur species.

It would be desirable to have a process for the selective separation sulfur compounds from olefin containing fuel feedstocks, like naphtha, thereby minimizing the loss of octane value. Ideally this process would use an inexpensive procedure that is applicable under a wide range of conditions. Such a process would represent a significant advance in the art and contribute to a cleaner environment.

Summary of the Invention

The present invention provides a process for separating a sulfur species from a liquid phase organic feedstream. The sulfur species have a first volatility and a remainder of the organic feedstream has a second volatility which is substantially the same as the first volatility rendering it difficult to separate the sulfur species from the remainder of the organic feedstream. The organic feedstream is contacted with a sulfur-selective solvent under extractive distillation conditions effective to decrease the first volatility to produce an overhead product comprising a lower volume percentage of the sulfur species than the feedstream, and a bottoms product comprising a higher volume percentage of the sulfur species than the feedstream.

DETAILED DESCRIPTION OF THE INVENTION

Figure 1:
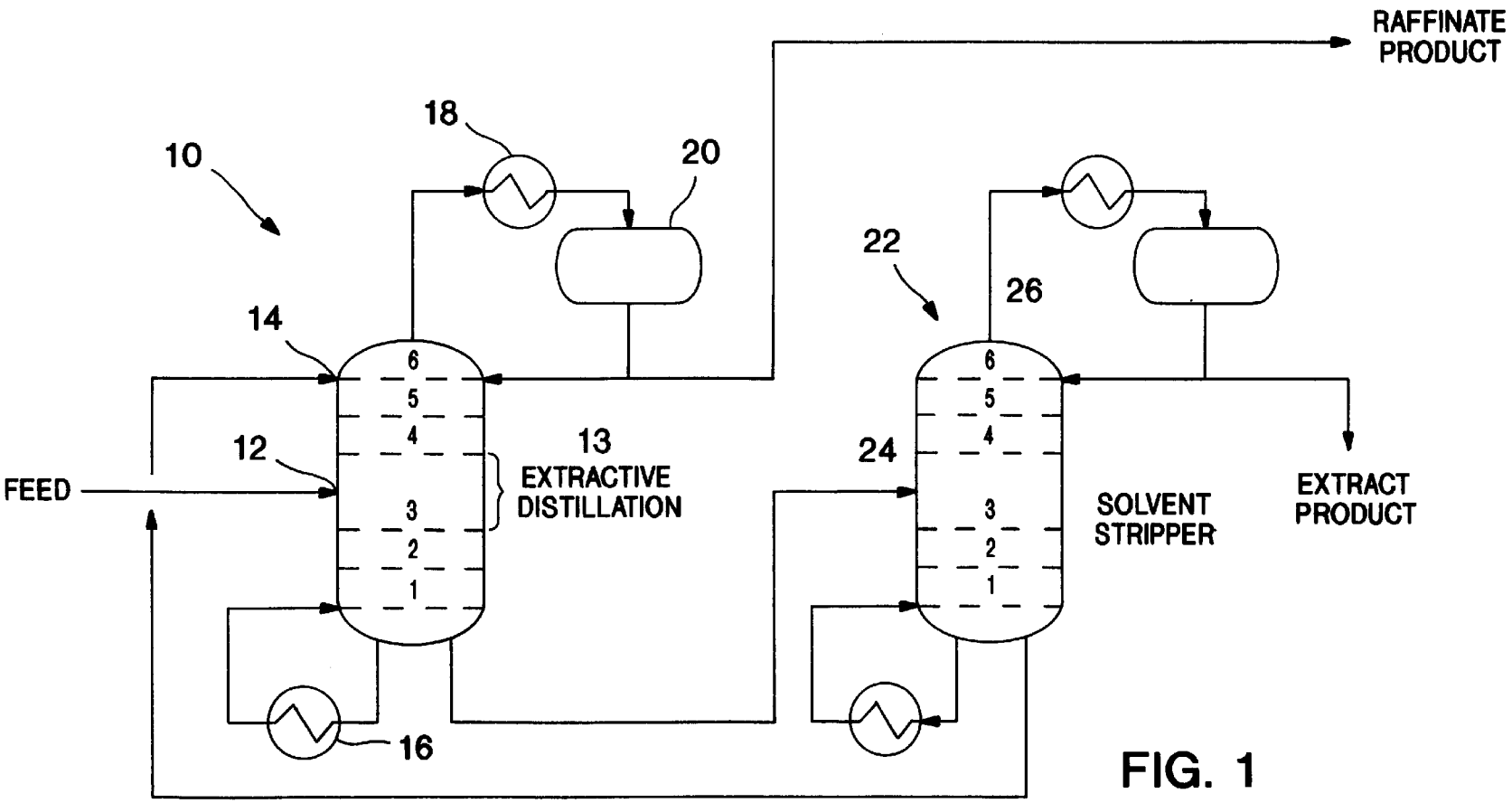
FIG. 1 is a process flow sheet for one embodiment of the extractive distillation process of the present invention.

The present invention relates to a process for separating sulfur species from organic feedstreams. More particularly, the present invention is directed to an extractive distillation process for separating aromatic sulfur species from naphtha streams for use in gasoline without substantially lowering the olefin content. The process of the present invention lowers the aromatic sulfur content of a naphtha feed stream by about a factor of 2 or more.

There is considerable worldwide interest in lowering the sulfur content of gasoline fuels. Current government regulations in Europe are calling for motor gasoline specifications of 150 ppm S, 1% benzene, 42% aromatics, and 18% olefins by 2000, and 50 ppm S, 35% aromatics by 2005. The U.S. likewise is considering proposals requiring 150 ppm S by 2000 and possibly 30 ppm by the year 2004. There are additional regulatory pressures from the worldwide fuel charter to produce gas having 30 ppm S, 1% benzene, 35% aromatics, and 10% olefins.

The present invention uses extractive distillation to achieve the goals of lowering the aromatic sulfur content of an organic feedstream while maintaining the olefin content. Although the process of the present invention is described in relation to a particular feedstream, it is believed that the process of the present invention could be used on other organic petroleum or petrochemical feedstreams including but not necessarily limited to chemical streams containing sulfur, steam cracked naphtha, and coker naphtha.

The process is particularly suited to treatment of the overhead from a cracking unit, preferably the overhead (FCC naphtha) from a fluid catalytic cracker (FCC). In an FCC unit, vacuum gas oil is cracked to smaller molecules having lower boiling points. The FCC naphtha product, that material boiling between about 35° C. and 235° C., is typically separated into two primary fractions. The overhead fraction preferably comprises a mixture of light cat naphtha (LCN) and intermediate cat naphtha (ICN), and the bottoms fraction contains heavy cat naphtha (HCN). In current processes, the LCN/ICN fraction is passed to a cat naphtha splitter or distillation tower where it is split into an LCN fraction and an ICN fraction. Unfortunately, the cat naphtha splitter permits some aromatic sulfur compounds to pass over into the LCN fraction. The current processes used to treat the LCN fraction are effective to remove sulfides and mercaptans and are not effective to remove aromatic sulfur compounds. As a result, the aromatic sulfur compounds present in the LCN fraction are passed to the gasoline pool. The present invention avoids contaminating the LCN fraction with aromatic sulfur compounds by substituting extractive distillation for simple distillation in a cat naphtha splitter.

Cracked naphtha streams suitable for treatment by extractive distillation typically contain paraffins, isoparaffins, olefins, naphthenes, and aromatics. In a preferred embodiment, the feedstream to extractive distillation comprises a mixture of LCN and ICN where the majority of the components have a boiling range of from about 35° C. to about 176° C. The sulfur content of the cracked naphtha stream will vary depending upon the source of the crude oil used to produce the cracked naphtha stream. The present invention may be used to separate aromatic sulfur species from the cracked naphtha stream such that the lower boiling portion of the cracked naphtha stream goes overhead while the solvent and aromatic sulfur species are contained in the bottoms product.

The invention will now be described with reference to FIG. 1. Referring to FIG. 1, the feedstream is fed to a suitable column 10 through inlet 12 into a separation zone. A suitable solvent is fed into the column through inlet 14, typically at a point above the feedstream inlet 12. Any suitable feed entry location can be selected. Generally the feed entry location is from about 2 to about 70 percent of the total height of the column, measured upward from the bottom of the column, preferably from about 5 to about 70 percent of the total height, more preferably from about 7 to about 70 percent of the total height.

The column 10 is provided with heat, preferably more near the bottom, via a reboiler 16. Any suitable temperature in the reboiler 16 (containing primarily the higher boiling feed components and the solvent) can be employed, depending upon the components of the feedstream and the solvent used. The temperature at the top of the column preferably is maintained at a temperature higher than the boiling point of the desired overhead stream. Any suitable pressure can be employed during the distillation as long as the pressure does not interfere with the desired separation. Generally the pressure is about 5 to about 100 psig, preferably about 5 to about 25 psig. The pressure is effective to permit the sulfur species, including aromatic species, to remain in solution with the particular solvent used.

The solvent and the feedstream generally are preheated before they are introduced into the column 10 to a temperature close to the column temperature of the corresponding entry point. The temperatures used are determined based on standard distillation column design parameters.

The solvent may be introduced through an inlet 14 at a suitable location. Generally the solvent inlet 14 is located at a position of from about 50 to about 99 percent of the total height of the packed or trayed column, preferably from about 70 to about 99 percent of the total height, more preferably from about 80 to about 99 percent of the total height.

Any suitable distillation column 10 may be used. A preferred configuration has stacked trays and uses any suitable column diameter, height, and number of trays. The exact dimensions and column designs depend on the scale of the operation, the exact feed composition, the exact solvent composition, the desired recovery and degree of purity of the various products, and the like, and can be determined by those having ordinary skill in the art.

Solvents useful in the practice of the present invention have a high affinity for sulfur species, preferably aromatic sulfur species, and have a boiling point that is different from the boiling point of the component to be separated. A solvent having a high affinity for sulfur species preferentially is attracted to sulfur containing organic compounds, causing a change in the relative volatilities of the components in a mixture, preferably an LCN/ICN mixture, allowing for the more efficient and effective separation of the components in the mixture by distillation. The solvent tends to have a high affinity for aromatic sulfur compounds and therefore reduces the aromatic content of the feedstream along with the sulfur content.

In addition to having a high affinity for sulfur compounds, suitable solvents generally are more polar than the feedstream. The polar nature of the solvent allows for interaction between the sulfur compound and the solvent such that the sulfur compound is maintained in a liquid state with the solvent at temperatures that are typically higher than the boiling point of the sulfur compound. Without limiting the invention to a particular mechanism, it is believed that a polar solvent interacts with the aromatic sulfur compounds through weak attractive forces. The solvent may be miscible or immiscible with the feedstream, provided that, if the solvent is immiscible with the feedstream, there is sufficient interaction between the sulfur compounds and the solvent to modify the volatility of the sulfur compounds.

Selection of the optimum solvent for liquid-liquid extraction of sulfur species can be done empirically or by using thermodynamic calculations based on solubility parameter theory. The former technique requires an experimental determination of solvent selectivity and capacity for each solvent of interest; and there is always the possibility that the optimum solvent may not be tested. Therefore, the solubility parameter theory is preferred. Solvents chosen for liquid-liquid extraction are also useful for extractive distillation;

however, it is also possible to include solvents that are totally miscible with the feed, such as nitrobenzene, since the separation is done by distillation and not by liquid-liquid phase separation.

A procedure for solvent selection is provided by Lo, T. C.; M. H. I. Baird and C. Hansen; *Handbook of Solvent Extraction,* p. 27, John Wiley and Sons, New York, N.Y., 1983 (referred to herein as "Hansen"). The Hansen procedure uses solubility parameter or cohesive energy density theory to choose which solvents have the proper affinity for the species to be separated. A compilation of solubility parameters for numerous solvents can be found in Barton, A. F. M.; *Handbook of Solubility Parameters and Other Cohesion Parameters,* CRC Press, Boca Raton, Fla., 1991. The Hansen three dimensional solubility parameter theory breaks the solubility parameter into three parts: London dispersion forces ($\delta_d$), polar forces ($\delta_p$), and hydrogen bonding forces ($\delta_H$). The total solubility parameter ($\delta_T$) is given by:

$$(\delta_T)^2=(\delta_d)^2+(\delta_p)^2+(\delta_H)^2 \quad (1)$$

Table 1 shows the solubility parameters for solvents evaluated for use in the present invention.

TABLE 1

| | Hansen Parameters | | | |
|---|---|---|---|---|
| | $\delta_d$ | $\delta_p$ | $\delta_H$ | $\delta_T$ |
| N-formylmorpholine | 19.5 | 13.7 | 10.8 | 26.2 |
| cellosolve | 16.2 | 9.2 | 14.3 | 23.5 |
| diethylene glycol | 16.2 | 14.7 | 20.5 | 30.0 |
| dipropylene glycol | 16.0 | 20.3 | 18.4 | 31.7 |
| ethylene carbonate | 19.4 | 21.7 | 5.1 | 29.6 |
| ethylene glycol | 17.0 | 11.1 | 26.0 | 33.0 |
| furfural | 16.8 | 14.9 | 5.1 | 23.0 |
| furfuryl alcohol | 17.4 | 7.6 | 15.1 | 24.3 |
| glycerol | 17.4 | 12.1 | 29.3 | 36.2 |
| methyl carbitol | 16.2 | 7.8 | 12.7 | 22.0 |
| methyl cellosol | 16.2 | 9.2 | 14.3 | 23.5 |
| N-methyl formamide | 16.0 | 27.4 | 10.7 | 32.9 |
| N-methyl 2-pyrrolidinone | 16.5 | 10.4 | 13.5 | 23.7 |
| 2-pyrrolidinone | 19.4 | 17.4 | 11.3 | 28.4 |
| propylene carbonate | 20.1 | 18.0 | 4.1 | 27.3 |
| propylene glycol | 16.8 | 9.4 | 23.3 | 30.2 |
| tetraethylene glycol | 16.6 | 5.7 | 16.8 | 24.3 |
| triethylene glycol | 16.0 | 12.5 | 18.6 | 27.5 |
| triethylene tetramine | 12.7 | 12.4 | 14.1 | 22.7 |
| phenol | 18.0 | 5.9 | 14.9 | 24.1 |
| morpholine | 18.8 | 4.9 | 9.2 | 21.5 |
| malonitrile | 17.6 | 22.6 | 8.8 | |
| sulfolane | 19.8 | 15.5 | 10.9 | 27.4 |
| thiophene | 14.0 | 12.4 | 7.5 | 20.1 |
| 2-methyl thiophene | 15.1 | 12.1 | 2.6 | 19.5 |
| 3-methyl thiophene | 15.2 | 12.1 | 1.8 | 19.5 |
| benzene | 16.1 | 8.6 | 4.1 | 18.7 |
| toluene | 16.4 | 8.0 | 1.6 | 18.3 |
| p-xylene | 16.5 | 7.0 | 2.0 | 18.0 |
| mesitylene | 16.7 | 7.0 | 0.0 | 18.1 |
| nonane | 15.6 | 0.0 | 0.0 | 15.6 |
| octane | 15.4 | 0.0 | 0.0 | 15.4 |
| 1-nonene | 15.4 | 3.4 | 0.0 | 15.8 |

Figure 2:
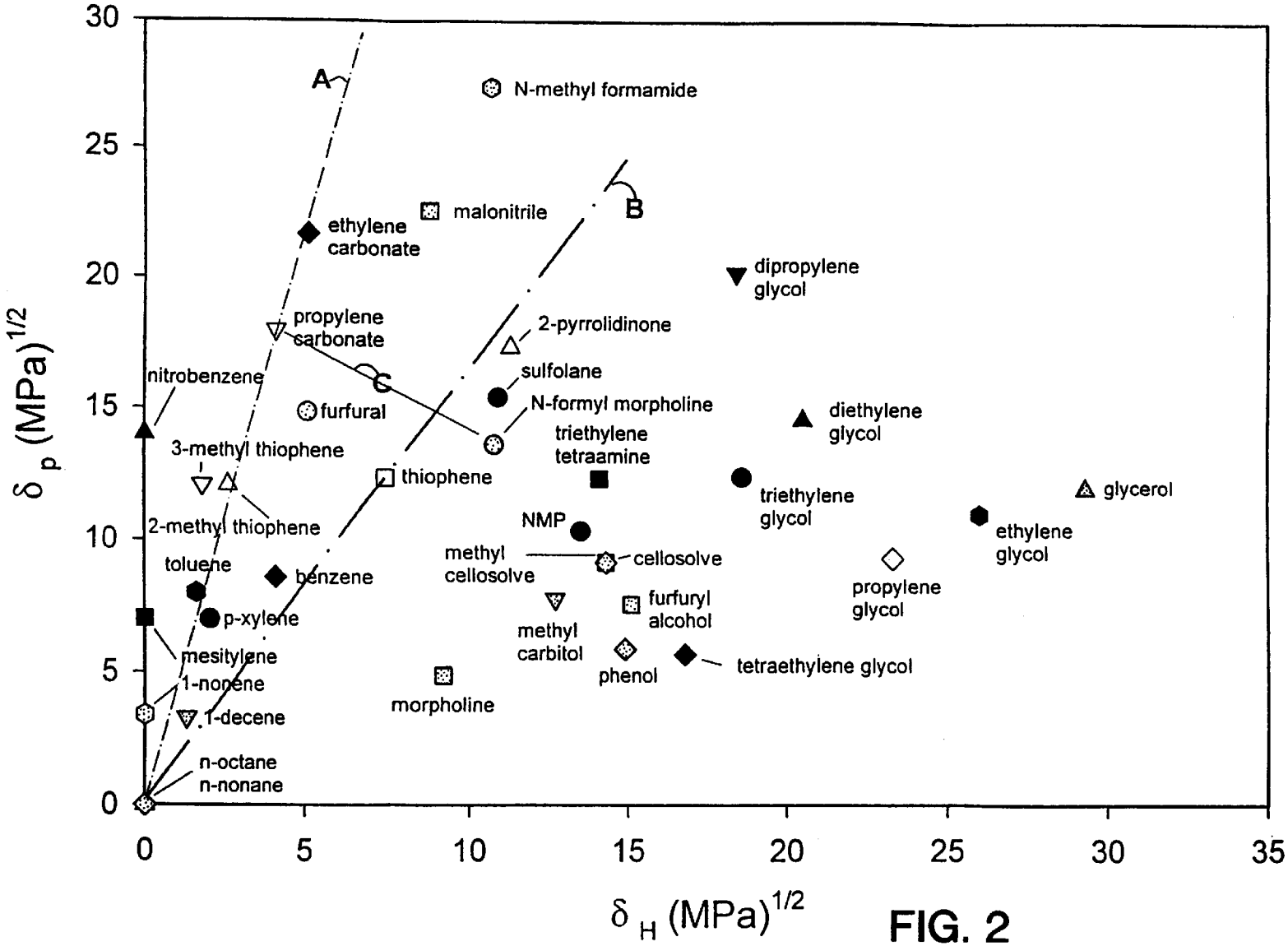
FIG. 2 is a plot of polar forces vs. hydrogen bonding forces of various solvents.

In one embodiment of the present invention, sulfur containing molecules are selectively extracted from cracked naphtha, which is a mixture of normal paraffins, isoparaffins, olefins, naphthenes, aromatics and heterocyclic sulfur and nitrogen species. Referring to FIG. 2, paraffins lie on or very near the origin and aromatic sulfur species are located typically between $\delta_p$ of 10 and 15 and a $\delta_H$ of 0 and 10. A line drawn from the origin through the solubility parameters of 2-methylthiophene and 3-methylethiophene is shown as the dashed line labeled A. Line A connects the paraffins with the sulfur species to be extracted and passes through the solubility parameters of propylene carbonate and ethylene carbonate. Therefore, by this technique, propylene carbonate and ethylene carbonate should be suitable solvents for sulfur extraction from naphtha. Propylene carbonate is a preferred solvent for use in the present invention. It is interesting to note that ethylene carbonate has a lower capacity for hydrocarbons which would tend to indicate that, by itself, it is not a preferred solvent. Mixtures of propylene carbonate and ethylene carbonate have, however, been found to work well with increasing concentrations of ethylene carbonate leading to lower capacity but higher selectivity for sulfur species.

Referring again to FIG. 2, line B was drawn through the origin and the solubility parameter of thiophene. A solvent close to this line, N-formylmorpholine, was chosen as a potential solvent for thiophene extraction and was found to be a good solvent for extraction of sulfur species from cracked naphtha. However, a mixture of N-formylmorpholine and propylene carbonate performed better as a solvent than either solvent alone.

Solid line C connects the solubility parameters of propylene carbonate and N-formylmorpholine. Mixtures of these two solvents have solubility parameters that lie on this line between the two pure solvents with a value determined by the relative proportions of the two solvents. The letter C lies approximately at a 50/50 mixture of the two solvents, which has been found to be a preferred solvent system for removal of sulfur species from cracked naphthas.

Preferred solvents for use in the present invention are chosen on the basis of the Hansen solubility parameter theory. It is important to note that not all solvents work equally well for the removal of sulfur species from cracked naphthas. Based on the solvent selection process described above, preferred solvents are those having both of the following conditions met $$1)\ \delta_p>1.45\ \delta_H \quad (2)$$

$$2)\ (\delta_p)^2+(\delta_H)^2>210 \quad (3)$$

Figure 3:
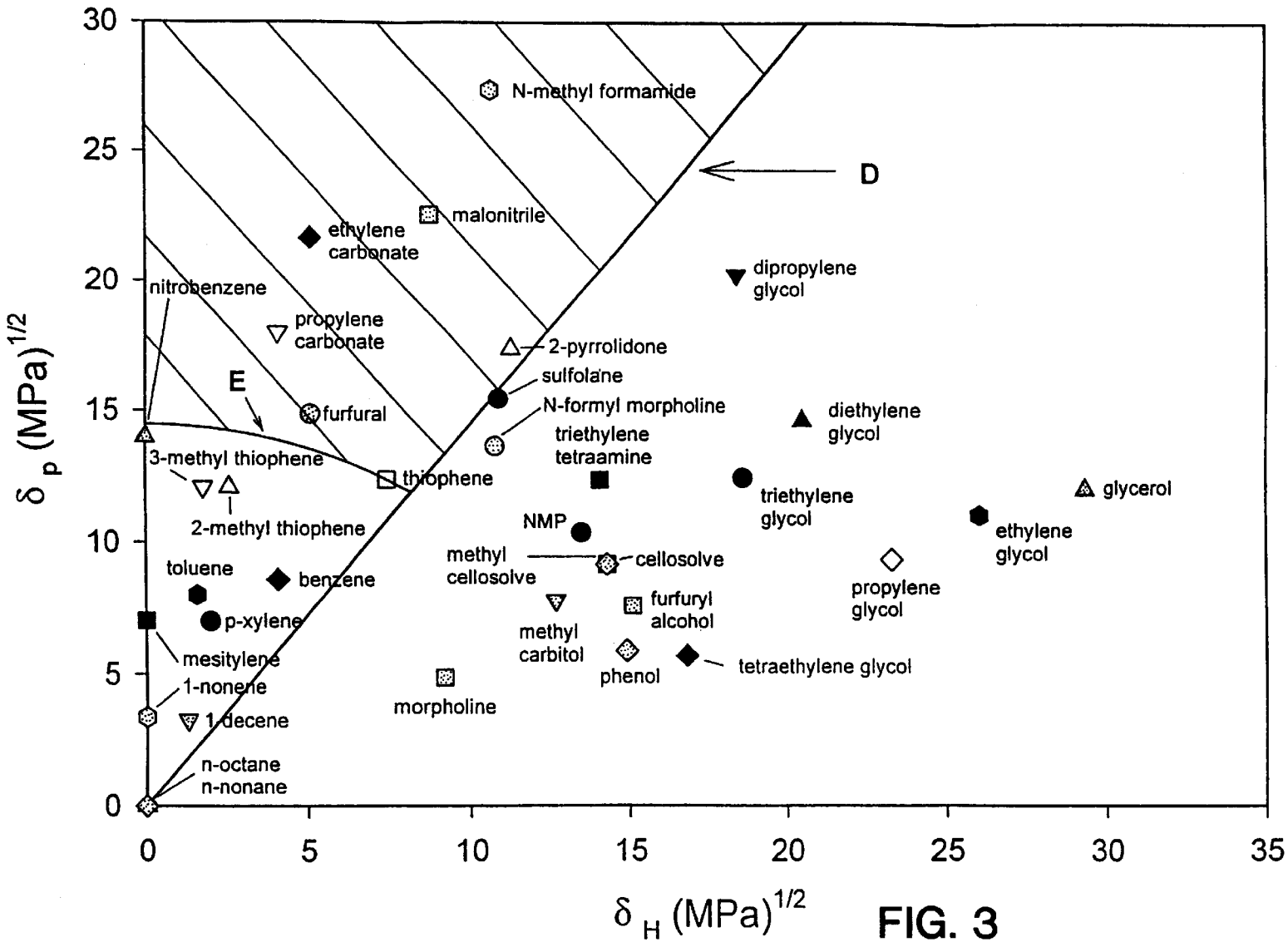
FIG. 3 is a plot of polar forces vs. hydrogen bonding forces of various solvents.

Referring to FIG. 3, Line D is a plot of $\delta_p=1.45\ \delta_H$; and therefore the first condition is met by all solvents falling above Line D. Line E is a circular arc having the equation $(\delta_p)^2+(\delta_H)^2=210$. Therefore, the second condition is met by all solvents falling above line E. Preferred solvents or combinations of solvents for cracked naphtha fall in the shaded portion of FIG. 3.

For extractive distillation it is not necessary that the solvent be immiscible with the feedstream, since the separation is by distillation. Therefore some preferred solvents are miscible with the feedstream. Nitrobenzene, for example, was found to work well in removing sulfur species from cracked naphthas; and it falls just outside the two phase region described by condition 2 above. Therefore, preferred miscible solvents would have both of the following conditions met $$1)\ \delta_p>1.45\ \delta_H \quad (4)$$

$$2)\ (\delta_p)^2+(\delta_H)^2>190 \quad (5)$$

In addition to pure solvents falling within the specified regions, combinations of solvents, which produce mixture solubility parameters that meet the conditions outlined in equations 2–5 also are preferred. The mixture solubility parameter is calculated as $$\delta_{mixture}=\Phi_1\delta_1+\Phi_2\delta_2+ \quad (6)$$

where $\Phi_1$=volume fraction of solvent 1

$\delta_1$=solubility parameter of solvent 1 as determined from two of the Hansen parameters by the formula $$\delta_1=\sqrt{\delta_{1p}^2+\delta_{1H}^2} \quad (7)$$

A 50 vol %/50 vol % mixture of propylene carbonate and N-formylmorpholine is an example of a mixture fitting this formula.

In a preferred embodiment, the solvent chosen has a higher boiling point than a lower boiling portion of the feedstream and acts to increase the boiling point of the sulfur species to maintain the sulfur species in a liquid phase while separating the lower boiling portion of the feedstream by distillation as a vapor.

A preferred feedstream is the LCN/ICN fraction from a catalytic cracker. The majority of the components present in the LCN/ICN feedstream have a boiling range of from about 36° C. to about 176° C. A majority of the aromatic sulfur compounds present in the LCN/ICN fraction are thiophenes, alkylthiophenes, and benzothiophene which have a boiling range of from about 84° C. to about 250° C. Suitable solvents for use in LCN/ICN feedstreams preferably have a boiling point of about 175° C. to about 320° C., most preferably from about 175° C. to about 250° C.

The sulfur selective solvent may be fully miscible, immiscible, or partially miscible with the bulk of the feedstream. This differs from liquid-liquid extraction where the solvent must be fully immiscible with the feedstream in order to separate the sulfur species from the bulk of the feedstream.

Any suitable weight ratio of the solvent to the hydrocarbon containing feed mixture can be employed. Generally, the solvent to feed weight ratio is from about 0.5:1 to about 4:1, preferably from about 1:1 to about 3:1, and more preferably from about 2:1 to about 2.5:1.

The overhead distillate product withdrawn from the top of the column 10 contains a smaller volume percentage of aromatic sulfur species than the feedstream and essentially all of the LCN; whereas the bottoms product contains a larger volume percentage of aromatic sulfur species than the feedstream and essentially all of the ICN. The concentration of aromatic sulfur species in the overhead product is at least two to three times lower than the original feedstream. The majority of the sulfur species present in the LCN are sulfides and mercaptans which can be easily separated by current processes. Preferably, the concentration of aromatic sulfur species in the LCN is about 200 ppm or less, more preferably about 50 ppm or less. The bottoms product contains essentially all of the added solvent, ICN, and aromatic sulfur compounds. The solvent in the bottoms product can be separated from the other bottoms product components by distillation or other suitable separating means and then be recycled to the extractive distillation column 10.

The overhead product comprising LCN and trace amounts of entrained sulfur-selective solvent is withdrawn from an upper fractionation zone of the column 10. The overhead product stream is then passed through a condenser 18 to convert the vapor to a liquid, and then the liquid is passed to a separator 20 to separate trace amounts of the sulfur-selective solvent from the product stream. The product stream is withdrawn from the separator 20 and typically is sent to any process capable of separating light mercaptans. The sulfur concentration in the LCN stream is further reduced by this process. The separated sulfur-selective solvent may then be re-used by feeding the same to the upper section of the distillation column 10.

The aromatic sulfur species, solvent, and higher boiling hydrocarbons are withdrawn from the bottom of the distillation column 10 and optionally are introduced into a simple distillation column 22 at an inlet 24, referred to herein as a solvent stripper 22. In the solvent stripper 22, the sulfur species and the hydrocarbons are disengaged from the extractive distillation solvent by distillation using known techniques. Generally, the column 22 is maintained under distillation conditions so that the sulfur containing species and higher boiling hydrocarbons are vaporized and taken off the top of the column 22 at outlet 26 and the extractive distillation solvent migrates to the bottom of the column 22. The extractive distillation solvent is withdrawn from the lower section of the solvent stripper 22 and recycled back to the distillation column 10. The sulfur species and hydrocarbons withdrawn from the upper section of the solvent stripper are in the ICN boiling range and can be hydrotreated by standard methods.

The data presented below relate to a single stage distillation column yielding sulfur separation down to 300 ppm. Persons of ordinary skill in the art will recognize that a column having multiple stages could be designed to separate sulfur species down to about 50 ppm or less.

EXAMPLES

Materials & Equipment

An Othmer equilibrium still, which is essentially a single equilibrium stage, was fabricated as shown by Lee, F. M., *Ind. Eng. Chem. Proc. Des. Dev.,* 1986, 25, 949–957. All vapor-liquid equilibrium data shown in the following examples were gathered in this equipment.

A stock solvent mixture comprising 278.06 g. mesitylene, 422.04 g. toluene and 300.08 g. n-heptane was prepared. A model sulfur feed solution comprising 2.66297 g. thiophene, 2.8381 g. 2-methylthiophene, 3.1046 g. 3-methylthiophene and 2.0950 g. benzothiophene was also prepared. A model feed stock solution was prepared by mixing 10.6674 gm model sulfur feed solution with 489.63 gm stock solvent mixture.

All sulfur analyses reported in these examples for both model feeds and naphthas were done using an HP 5890 gas chromatograph equipped with a 30 meter fused silica capillary column, a flame ionization detector and a Sievers Model 355 sulfur chemiluminescence detector.

Example 1

Vapor liquid equilibria (VLE) data were collected in the absence of a solvent by diluting model feed stock solution with Stock solvent mixture, charging the mixture to the equilibrium cell and allowing the system to come to equilibrium as determined by no change in the overhead composition with time. Analysis of the overhead samples for four different feed concentrations are shown in Table 1.

TABLE 1

Vapor Liquid Equilibria for Naphtha Distillation

| | | Sulfur Concentration | | | | | | | |
|---|---|---|---|---|---|---|---|---|---|
| | | T (ppm) | | 2 MT (ppm) | | 3 MT (ppm) | | BZT (ppm) | |
| Solvent (g) | Feed (g) | Liquid | Vapor | Liquid | Vapor | Liquid | Vapor | Liquid | Vapor |
| 50 | 50 | 988 | 3210 | 1017 | 1195 | 1156 | 1222 | 518 | 13.2 |
| 74 | 26 | 513 | 1642 | 527 | 606 | 600 | 614 | 264 | 6.6 |
| 86 | 14 | 243 | 780 | 246 | 291 | 280 | 301 | — | — |
| 94 | 6 | 127 | 354 | 129 | 128 | 147 | 133 | — | — |

where:

T=thiophene

2MT=2-methylthiophene

3MT=3-methylthiophene

BZT=-benzothiophene

As can be seen, the vapor samples are significantly enriched with the lowest boiling sulfur species, thiophene, and slight enriched with 2MT and 3MT, which boil somewhat higher. Benzothiophene is not carried overhead to any significant extent due to its high boiling point.

Example 2

These experiments were repeated using half as much of each of the feed samples and 100 grams of an extraction solvent, N-formylmorpholine (NFM). Results are shown in Table 2 below.

TABLE 2

Vapor Liquid Equilibria for Extractive Distillation with N-Formylmorpholine

| Solven | Feed | NFM | Sulfur Concentration T (ppm) | | 2 MT (ppm) | | 3 MT (ppm) | | BZT (ppm) | |
|---|---|---|---|---|---|---|---|---|---|---|
| (g) | (g) | (g) | Liquid | Vapor | Liquid | Vapor | Liquid | Vapor | Liquid | Vapor |
| 25 | 25 | 100 | 988 | 1062 | 1017 | 482 | 1156 | 463 | 518 | 3.3 |
| 37 | 13 | 100 | 513 | 539 | 527 | 242 | 600 | 233 | 264 | — |
| 43 | 7 | 100 | 243 | | 246 | | 280 | | — | — |
| 47 | 3 | 100 | 127 | 132 | 129 | 59 | 147 | 57 | — | — |

As can be seen, the concentration of sulfur species in the overhead is reduced by a factor of 2 to 4 by the presence of the extraction solvent.

Example 3

The next series of experiments were done with the 170° F.+ fraction of a wide range cat naphtha from the Baton Rouge, La. refinery. The properties of the wide range cat naphtha and its 170° F.+ fraction are shown in the Table 3 below:

TABLE 3

Properties of Naphtha Used in Extractive Distillation

| | Wide-cut Naphtha | 170° F.+ Fraction |
|---|---|---|
| Gravity, API | 62.4 | — |
| Sulfur (ppm) | 1180 | 1406 |
| Nitrogen (ppm) | 42 | — |
| Bromine No. | 46.4 | — |
| Aromatics (vol. %) | 21.7 | 46.8 |
| Olefins (vol. %) | 34.9 | 22.4 |
| Saturates (vol. %) | 43.4 | 29.1 |
| MON, clear | 81.8 | 82.5 |
| RON, clear | 92.8 | 92.6 |

Approximately 100 grams of 170° F.+ naphtha was mixed with 100 grams of a solvent in the Othmer still and equilibrium was established. Sampling of the vapor phase produced the results shown in Table 4.

TABLE 4

Effect of Various Solvents on Sulfur Content of Naphtha Overhead in Extractive Distillation

| Solvent | Feed Sulfur (ppm) | Vapor Sulfur Composition (ppm) None | TEG | NFM | PC | 75EC/25PC | NMP | TBP |
|---|---|---|---|---|---|---|---|---|
| Temperature in | | | | | | | | |
| Liquid (° C.) | | 117.5~118.4 | 118.1~118.3 | 122.1~122.3 | 116.6~116.9 | 116.7~117.5 | 130.2~130.7 | 131.2~131.5 |
| Vapor (° C.) | | 105.7~106.2 | 104.4~105.6 | 105.4~106.1 | 101.2~101.5 | 103.0~104 | 107.2~107.6 | 107.1~107.7 |
| Solvent:Feed Ratio | | 0 | 1 | 1 | 1 | 1 | 1 | 1 |
| thiophene | 59.4 | 174.1 | 124.8 | 89.1 | 104.0 | 93.8 | 86.4 | 127.8 |
| 2-methylthiophene | 156.2 | 193.6 | 151.0 | 106.3 | 108.3 | 125.9 | 113.6 | 164.8 |
| 3-methylthiophene | 145.1 | 183.7 | 128.8 | 101.5 | 93.4 | 110.4 | 101.4 | 142.0 |
| benzothiophene | 158.2 | 6.5 | 4.1 | <1 | <1 | <1 | <1 | 5.3 |
| Total Sulfur | 1405.7 | 827.7 | 650.6 | 459.5 | 451.6 | 486.7 | 497.8 | 674.5 |

where:

TEG=tetrathylene glycol

NFM=N-formylmorpholine

PC=propylene carbonate

75EC/25PC=75 wt % ethylene carbonate/25 wt % propylene carbonate

NMP=N-methylpyrrolidone

TBP=tributylphosphate

It is clear that all solvents have some effect in reducing the overall sulfur content of the vapor stream. N-formylmorpholine and propylene carbonate lowered the sulfur levels more than the others.

Example 4

The effect of solvent to feed ratio on sulfur reduction in the vapor was studied using a 50 wt % NFM/50 wt % PC mixture as the solvent. Results from these tests are shown in Table 5.

TABLE 5

Effect of Solvent to Feed Ratio on Sulfur Reduction in Overhead

| Solvent | | None | 50PC/50 4-FM | | | | |
|---|---|---|---|---|---|---|---|
| Temperature in | | | | | | | |
| Liquid (° C.) | | 116.9~117.0 | 118.4~118.5 | 118.9 | 124.4~124.7 | 127.8~127.9 | 180.1~180.3 |
| Vapor (° C.) | | 101.2~101.5 | 100.6~100.9 | 103.4~103.5 | 107.0~107.9 | 103.6~103.9 | 125.5~126.0 |
| Solvent:Feed Ratio | | 0 | 1 | 2 | 2.25 | 4 | 5 |
| | Sulfur (ppm) | | | | | | |
| | Liquid | Vapor | | | | | |
| thiophene | 62.5 | 167.4 | 82.3 | 67.8 | 63.5 | 83.7 | 64.1 |
| 2-methylthiophene | 168.1 | 235.2 | 100.7 | 76.8 | 88.6 | 94.4 | 153.9 |
| 3-methylthiophene | 163.8 | 203.9 | 85.2 | 60.7 | 72.2 | 72.8 | 133.6 |
| benzothiophene | 156.5 | 53 | <1 | <1 | 2.5 | −1 | 3 |
| Total Sulfur | 1426.1 | 911.9 | 396.2 | 300.6 | 378.3 | 376.1 | 645.7 |

From these data it can be seen that a solvent to feed ratio of between 2 and 3 is sufficient to achieve the optimum reduction in sulfur in the overhead stream.

Example 5

Additional work was done using several solvents and mixtures of solvents and additives (e.g. oxalic acid). Results are shown in Table 6 below:

TABLE 6

Effect of Additional Solvents and Mixtures on Sulfur Reduction in Overhead

| Solvent | Feed Sulfur (ppm) | Vapor Sulfur Composition (ppm) | | | | | |
|---|---|---|---|---|---|---|---|
| | | None | Nitrobenzene | 90% NFM 5% $H_2O$ 5% Urea | 90% NFM 5% $H_2O$ % Succinic aci | 95% PC 5% Oxalic acid | 95% PC 5% Malonitrile |
| Temperature in | | | | | | | |
| Liquid (° C.) | | 116.9~117.0 | 129.0 | 105.3~105.4 | 107.4 | 118.6~118.9 | 117.9~118.1 |
| Vapor (° C.) | | 101.2~101.5 | 104.9~105.4 | 85.0~85.4 | 89.2~89.5 | 105.9~106.1 | 104.7~105.6 |
| Solvent:Feed Ratio | | 0 | 1 | 1 | 1 | 1 | 1 |
| thiophene | | | | | | | |
| thiophene | 62.5 | 167.4 | 69.4 | 81.8 | 67.4 | 100.5 | 107.8 |
| 2-methylthiophene | 168.1 | 235.2 | 110.8 | 113.5 | 119.7 | 121 | 126.5 |
| 3-methylthiophene | 163.8 | 203.9 | 98.5 | 97 | 101.1 | 104.5 | 108.4 |
| benzothiophene | 156.5 | 5.3 | <1 | 1.7 | <1 | 3 | <1 |
| Total Sulfur | 1426.1 | 911.9 | 444.2 | 457.7 | 452.3 | 463.7 | 524.4 |

As can be seen, nitrobenzene lowers the sulfur level significantly when used alone, while additives exert a small promotional effect.

From the foregoing experiments, it was determined that a wide variety of heterocyclic organic compounds are useful as extractive distillation solvents for separating sulfur species from organic feedstreams. The solvent chosen will vary depending upon the components of the feedstream and their relative boiling points.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

What is claimed is:

1. A process for separating a sulfur species from an organic feedstream comprising:

providing a liquid phase organic feedstream comprising a first concentration of sulfur species, said sulfur species having a first volatility and a remainder of said organic feedstream having a second volatility which is substantially the same as said first volatility rendering it difficult to separate said sulfur species from said remainder of said organic feedstream; and contacting said liquid phase organic feedstream with a liquid phase sulfur-selective solvent under extractive distillation conditions effective to decrease said first volatility to produce an overhead product comprising a second concentration of sulfur species that is less than said first concentration and a bottoms product comprising a third concentration of said sulfur species that is more than said first concentration, wherein the sulfur-selective solvent is selected from solvents having polar forces ($\delta_p$) and hydrogen bonding forces ($\delta_H$) that satisfy the following equations:

$$\delta_p > 1.45\ \delta_H \quad 1)$$

$$(\delta_p)^2 + (\delta_H)^2 > 190. \quad 2)$$

2. The process of claim 1, wherein said feedstream comprises light cat naphtha and intermediate cat naphtha.

3. The process of claim 2, wherein said feedstream has a boiling point of from about 36° C. to about 176° C.

4. The process of claim 3, wherein said sulfur-selective solvent has a boiling point of from about 175° C. to about 320° C.

5. The process of claim 3, wherein said sulfur species comprises aromatic compounds having a boiling point of from about 84° C. to about 250° C.

6. The process of claim 1, wherein said sulfur-selective solvent is selected from the group consisting of organic compounds comprising at least one atom selected from the group consisting of oxygen, sulfur and nitrogen.

7. The process of claim 2, wherein said sulfur-selective solvent is selected from the group consisting of organic compounds comprising at least one atom selected from the group consisting of oxygen, sulfur and nitrogen.

8. The process of claim 1, wherein said sulfur-selective solvent comprises a mixture comprising at least a first solvent having a first solubility parameter ($\delta_1$) and a second solvent having a second solubility parameter ($\delta_2$), wherein said mixture comprises a solubility parameter defined by the following equation:

$$(\delta_{mixture}) = \Phi_1(\delta_1) + \Phi_1(\delta_2)[+\Phi_x(\delta_x)]_n$$

wherein $\Phi$ is the volume fraction of said solvent in said mixture;

x designates additional solvents in said mixture; and n is 0 or a designation for an additional solvent in said mixture; and wherein said solubility parameter of each solvent ($\delta_{solvent}$) is determined by the following equation:

$$\delta_{solvent} = \sqrt{\delta_p^2 + \delta_H^2}.$$

9. The process of claim 3, wherein said sulfur-selective solvent is selected from ethylene carbonate and propylene carbonate and mixtures thereof, and solvent mixtures containing N-formylmorpholine and nitrobenzene.

10. A process for separating aromatic sulfur species from an organic feedstream comprising:

passing said feedstream into an extractive distillation column;

contacting said feedstream within said extractive distillation column with a sulfur-selective solvent under extractive distillation conditions effective to separate said aromatic sulfur species from said feedstream; and withdrawing an overhead product from said extractive distillation column, wherein the sulfur-selective solvent is selected from solvents having polar forces ($\delta_p$) and hydrogen bonding forces ($\delta_H$) that satisfy the following equations:

$$\delta_p > 1.45\ \delta_H \quad 1)$$

$$(\delta_p)^2 + (\delta_H)^2 > 190. \quad 2)$$

11. The process of claim 10, wherein said feedstream comprises light cat naphtha and intermediate cat naphtha, wherein a majority if the components have a boiling point of from about 36° C. to about 176° C.

12. The process of claim 10, wherein said sulfur-selective solvent has a boiling point of from about 175° C. to about 320° C.

13. The process of claim 10, wherein said feedstream comprises a first concentration of said aromatic sulfur species and said overhead product comprises a second concentration of said aromatic sulfur species that is less than said first concentration and said bottoms product comprises a third concentration of said aromatic sulfur species that is more than said first concentration.

14. The process of claim 10, wherein said sulfur-selective solvent is selected from ethylene carbonate and propylene carbonate and mixtures thereof, and solvent mixtures containing N-formylmorpholine and nitrobenzene.

15. The process of claim 10, wherein said sulfur-selective solvent comprises a mixture comprising at least a first solvent having a first solubility parameter ($\delta_1$) and a second solvent having a second solubility parameter ($\delta_2$), wherein said mixture comprises a solubility parameter defined by the following equation:

$$(\delta_{mixture}) = \Phi_1(\delta_1) + \Phi_1(\delta_2)[+\Phi_x(\delta_x)]_n$$

wherein $\Phi$ is the volume fraction of said solvent in said mixture;

x designates additional solvents in said mixture; and n is 0 or a designation for an additional solvent in said mixture; and wherein said solubility parameter of each solvent ($\delta_{solvent}$) is determined by the following equation:

$$\delta_{solvent}=\sqrt{\delta_{p^2+\delta_{H^2}}}.$$

16. A process for separating aromatic sulfur species from an organic feedstream comprising:

providing an organic feedstream comprising a first concentration of aromatic sulfur species having a boiling point of from about 84° C. to about 250° C. and a mixture comprising a first portion having a boiling point of from about 36° C. to about 76° C. and a second portion having a boiling point of from about 76° C. to about 176° C.; and contacting the organic feed stream with a sulfur-selective solvent under extractive distillation conditions effective to increase the boiling point of said aromatic sulfur species to facilitate the separation of said aromatic sulfur species from said first portion to produce an overhead product comprising said first portion and a second concentration of said aromatic sulfur species that is less than said first concentration and a bottoms product comprising said second portion and a third concentration of said aromatic sulfur species that is more than said first concentration, wherein the sulfur-selective solvent is selected from solvents having polar forces ($\delta_p$) and hydrogen bonding forces ($\delta_H$) that satisfy the following equations:

$$\delta_p>1.45\ \delta_H \quad 1)$$

$$(\delta_p)^2+(\delta_H)^2>190. \quad 2)$$

17. The process of claim 16 wherein said sulfur-selective solvent is selected from ethylene carbonate and propylene carbonate and mixtures thereof, and solvent mixtures containing N-formylmorpholine and nitrobenzene.

18. The process of claim 16, wherein said sulfur-selective solvent comprises a mixture comprising at least a first solvent having a first solubility parameter ($\delta_1$) and a second solvent having a second solubility parameter ($\delta_2$), wherein said mixture comprises a solubility parameter defined by the following equation:

$$(\delta_{mixture})=\Phi_1(\delta_1)+\Phi_1(\delta_2)[+\Phi_x(\delta_x)]_n$$

wherein $\Phi$ is the volume fraction of said solvent in said mixture;

x designates additional solvents in said mixture; and n is 0 or a designation for an additional solvent in said mixture; and wherein said solubility parameter of each solvent ($\delta_{solvent}$) is determined by the following equation:

$$\delta_{solvent}=\sqrt{\delta_{p^2+\delta_{H^2}}}.$$

19. The process of claim 10, wherein said overhead product comprises a concentration of said aromatic sulfur species of about 150 ppm or less.

20. The process of claim 10, wherein said overhead product comprises a concentration of said aromatic sulfur species of about 50 ppm or less.

21. The process of claim 16, wherein said second concentration of said aromatic sulfur species is about 150 ppm or less.

22. The process of claim 16, wherein said second concentration of said aromatic sulfur species is about 50 ppm or less.

* * * * *